US011976830B2

(12) United States Patent
Watanabe et al.

(10) Patent No.: US 11,976,830 B2
(45) Date of Patent: May 7, 2024

(54) AIR-CONDITIONING APPARATUS

(71) Applicant: Mitsubishi Electric Corporation, Tokyo (JP)

(72) Inventors: Kazuki Watanabe, Tokyo (JP); Masahiko Takagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 416 days.

(21) Appl. No.: 17/289,774

(22) PCT Filed: Jan. 22, 2019

(86) PCT No.: PCT/JP2019/001765
§ 371 (c)(1),
(2) Date: Apr. 29, 2021

(87) PCT Pub. No.: WO2020/152765
PCT Pub. Date: Jul. 30, 2020

(65) Prior Publication Data

US 2021/0396412 A1 Dec. 23, 2021

(51) Int. Cl.
*F24F 11/36* (2018.01)
*F25B 41/24* (2021.01)
*F25B 49/02* (2006.01)

(52) U.S. Cl.
CPC ..... *F24F 11/36* (2018.01); *F25B 41/24* (2021.01); *F25B 49/02* (2013.01); *F25B 2500/222* (2013.01)

(58) Field of Classification Search
CPC ..... F24F 11/36; F24F 1/0047; F24F 11/64; F24F 2013/0616; F25B 41/24; F25B 49/02; F25B 2500/222
See application file for complete search history.

(56) References Cited

U.S. PATENT DOCUMENTS

2013/0227977 A1 9/2013 Morimoto et al.
2018/0094844 A1 4/2018 Suzuki
2018/0187917 A1 7/2018 Suzuki et al.

FOREIGN PATENT DOCUMENTS

CN 102162666 A * 8/2011
CN 102162666 A 8/2011
(Continued)

OTHER PUBLICATIONS

Office Action dated Jan. 4, 2022 issued in corresponding JP patent application No. 2020-567691 (and English translation).
(Continued)

*Primary Examiner* — Ana M Vazquez
(74) *Attorney, Agent, or Firm* — POSZ LAW GROUP, PLC

(57) ABSTRACT

An air-conditioning apparatus performs air conditioning by causing heat exchange between refrigerant cycling through a refrigerant circuit and indoor and outdoor air. The air-conditioning apparatus includes a sensor and a control determination device. The sensor measures concentration of any of the refrigerant leaked into the air. The control determination unit determines leakage of the refrigerant in a case when the concentration of any refrigerant leaked into the air is greater than a first threshold. The control determination device further determines an abnormality in the sensor in any one of a case where a cumulative time period of determined leakages is greater than a predetermined time period, a case where a cumulative number of times of determined leakages is greater than a predetermined number, and a case where the value indicating the concentration of any refrigerant leaked into the air is greater than a higher second threshold.

10 Claims, 4 Drawing Sheets

(56) References Cited

FOREIGN PATENT DOCUMENTS

| | | | | |
|---|---|---|---|---|
| CN | 107560098 | A | 1/2018 | |
| EP | 3 376 140 | A2 | 9/2018 | |
| GB | 2575606 | A | 1/2020 | |
| JP | H04-369370 | A | 12/1992 | |
| JP | 2017-015393 | A | 1/2017 | |
| WO | 2012/098584 | A1 | 7/2012 | |
| WO | 2018/220758 | A1 | 12/2016 | |
| WO | 2017/026014 | A1 | 2/2017 | |
| WO | WO-2018220758 | A1 * | 12/2018 | ..... F24F 11/36 |

OTHER PUBLICATIONS

International Search Report dated Apr. 2, 2019, issued in corresponding International Patent Application No. PCT/JP2019/001765.
Office Action dated Apr. 26, 2022 issued in corresponding CN Patent Application No. 201980074463.3 (and English Machine Translation).
Office Action dated Jan. 29, 2024 issued in corresponding DE Patent Application No. 112019006714.1 (and English translation).

* cited by examiner

AIR-CONDITIONING APPARATUS

CROSS REFERENCE TO RELATED APPLICATION

This application is a U.S. National Stage Application of International Application No. PCT/JP2019/001765 filed on Jan. 22, 2019, the contents of which are incorporated herein by reference.

TECHNICAL FIELD

The present disclosure relates to an air-conditioning apparatus including a refrigerant sensor that detects leakage of a refrigerant gas.

BACKGROUND ART

Recently, for an air-conditioning apparatus that causes refrigerant to cycle therethrough to thereby cause heat to be exchanged between the refrigerant and indoor and outdoor air, thus conditioning indoor air, a refrigerant having a low global-warming potential (GWP) index is used, such as R32 or R152a, in many cases from an environmental viewpoint. However, such a refrigerant may have flammability. Accordingly, the air-conditioning apparatus is provided with a refrigerant sensor for detecting the leakage of refrigerant in many cases. For example, an air-conditioning apparatus disclosed in Patent Literature 1 stops the operation when the leakage of refrigerant is detected by a refrigerant sensor (refrigerant leakage detector). Further, the air-conditioning apparatus invalidates an operation performed by a user, and turns on an indoor fan for a predetermined time period. At the same time, the air-conditioning apparatus controls an expansion valve, a gas-side opening and dosing valve, a compressor, and other components to reduce the amount of leakage of refrigerant. The air-conditioning apparatus can restart the operation when a reset button is pressed by an operator.

CITATION LIST

Patent Literature

Patent Literature 1: Japanese Unexamined Patent Application Publication No. 4-369370

SUMMARY OF INVENTION

Technical Problem

A semiconductor gas sensor is generally used as a sensor unit included in the refrigerant sensor for detecting the leakage of refrigerant. The semiconductor gas sensor also detects other substances in addition to refrigerant, so may cause an erroneous detection. Further, when the semiconductor gas sensor is exposed to a gas with a high concentration or is exposed to a gas for a long time period, the characteristics of the semiconductor gas sensor are significantly changed. Such a change in characteristics may cause the desensitization of the semiconductor gas sensor to such an extent that the semiconductor gas sensor cannot detect the leakage of a gas.

The above-mentioned Patent Literature 1 fails to describe the upper limit of count of exposure to a gas (also referred to as "count of exposure") (also referred to as "upper exposure count limit") in the use of the refrigerant sensor. In the same manner, the above-mentioned Patent Literature 1 fails to describe a cumulative exposure time period obtained by cumulating the time periods during which the refrigerant sensor is exposed to a gas and to describe the upper limit of the cumulative exposure time period (also referred to as "upper cumulative exposure time period limit") in the use of the refrigerant sensor. Therefore, in the above-mentioned air-conditioning apparatus, there is a possibility that the refrigerant sensor is used a plurality of times exceeding the upper exposure count limit or is used for a time period exceeding the upper cumulative exposure time period limit due to repeated pressing of a reset button and hence, the desensitized refrigerant sensor is used. As a result, there is a possibility that leakage of refrigerant is not detected even when refrigerant is leaked.

The present disclosure has been made to overcome the above-mentioned problem, and it is an object of the present disclosure to provide an air-conditioning apparatus that can prevent omission of detection of leaked refrigerant.

Solution to Problem

An air-conditioning apparatus according to an embodiment of the present disclosure is an air-conditioning apparatus that causes refrigerant to cycle through the air-conditioning apparatus to cause heat exchange to be performed between the refrigerant and indoor and outdoor air, thus performing air conditioning, the air-conditioning apparatus including: a measuring unit configured to measure a concentration in air of the refrigerant leaked into the air; a control determination unit configured to determine leakage of the refrigerant in a case where a value indicating the concentration measured by the measuring unit is equal to or more than a first threshold; and a storage unit configured to cumulate and store at least one of a time period elapsed during a determination of the leakage of the refrigerant and a number of times of the determination of the leakage of the refrigerant; wherein the control determination unit prohibits the air conditioning action in at least one case out of a case where the time period cumulated is equal to or more than a predetermined time period, a case where the number of times cumulated is equal to or more than a predetermined number, and a case where the value indicating the concentration is equal to or more than a second threshold, being a value greater than the first threshold.

Advantageous Effects of Invention

In the air-conditioning apparatus according to the embodiment of the present disclosure, deterioration of the refrigerant sensor is detected based on at least one of the cumulative time period obtained by cumulating time periods elapsed during the determination of the leakage of refrigerant, the cumulative number of times obtained by cumulating the number of times of the determination of the leakage of refrigerant, and the presence or absence of the leakage of refrigerant with a high concentration. With such a configuration, it is possible to prevent omission of detection of leaked refrigerant that may occur with the use of a deteriorated refrigerant sensor.

DESCRIPTION OF EMBODIMENTS

Hereinafter, Embodiment of the present disclosure will be described in detail with reference to drawings.

(Refrigerant Circuit)

Embodiment

Figure 1:
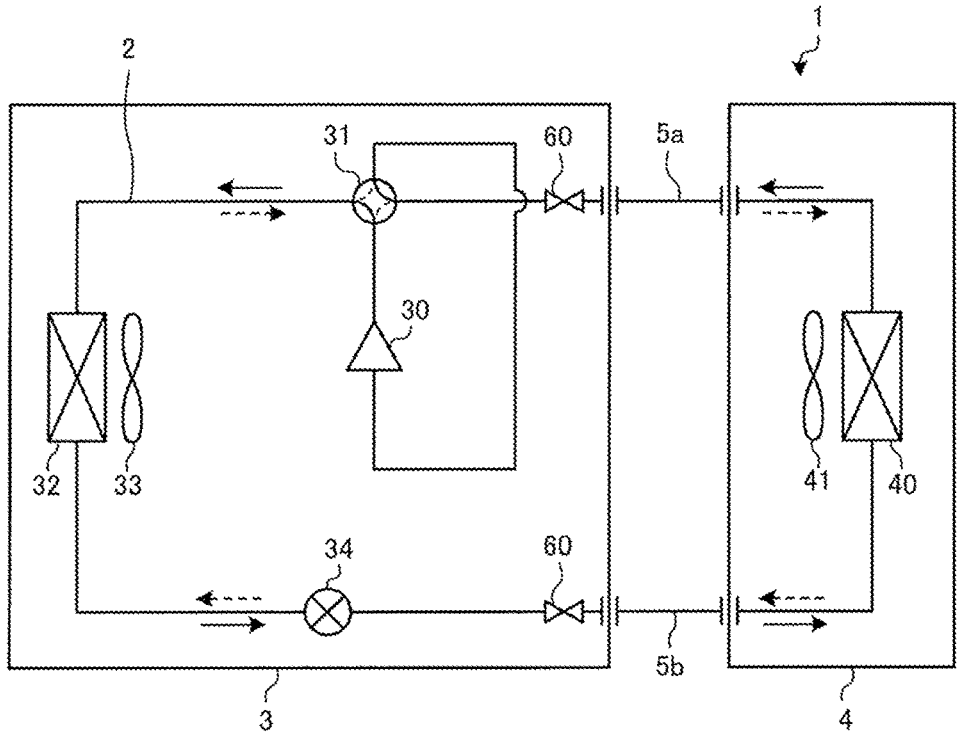
FIG. 1 is a schematic view showing one example of the configuration of a refrigerant circuit included in an air-conditioning apparatus according to Embodiment of the present disclosure.

FIG. 1 is a schematic view showing one example of the configuration of a refrigerant circuit 2 included in an air-conditioning apparatus 1 according to Embodiment of the present disclosure. The air-conditioning apparatus 1 is a device that causes refrigerant to cycle through the refrigerant circuit 2 to cause heat exchange to be performed between the refrigerant and each of indoor air and outdoor air, thus conditioning air. The air-conditioning apparatus 1 includes an outdoor unit 3 and an indoor unit 4 in the refrigerant circuit 2. The outdoor unit 3 and the indoor unit 4 are connected with each other by refrigerant pipes 5*a*, 5*b*, forming portions of the refrigerant circuit 2. To facilitate the understanding, in this Embodiment, the description will be made for a case where the air-conditioning apparatus 1 includes one outdoor unit 3 and one indoor unit 4. However, the present disclosure is not limited to such a configuration. The air-conditioning apparatus 1 may include a plurality of outdoor units 3 or a plurality of indoor units 4, for example.

The outdoor unit 3 includes a compressor 30, a flow passage switching device 31, an outdoor heat exchanger 32, an outdoor fan 33, an expansion valve 34, and other components. The outdoor unit 3 is also provided with shutoff valves 60 at positions outside or inside the outdoor unit 3. The compressor 30 compresses and discharges suctioned refrigerant. The flow passage switching device 31 may be a four-way valve, for example, and is a device for switching the direction of a flow passage for refrigerant (also referred to as "refrigerant flow passage"). The air-conditioning apparatus 1 can switch the operation from a heating operation to a cooling operation, or from the heating operation to the cooling operation by switching the refrigerant flow passage using the flow passage switching device 31. The solid line portions in the flow passage switching device 31 shown in FIG. 1 indicate a refrigerant flow passage during the cooling operation, and the broken line portions in the flow passage switching device 31 shown in FIG. 1 indicate a refrigerant flow passage during the heating operation. In the same manner, solid line arrows in FIG. 1 indicate a direction in which refrigerant flows during the cooling operation, and broken line arrows indicate a direction in which refrigerant flows during the heating operation.

The outdoor heat exchanger 32 exchanges heat between refrigerant and outdoor air. The outdoor heat exchanger 32 acts as a condenser during the cooling operation. Specifically, the outdoor heat exchanger 32 exchanges heat between outdoor air and refrigerant compressed by the compressor 30 and flowing into the outdoor heat exchanger 32 from a refrigerant pipe 5*a* side via the flow passage switching device 31 to cause the refrigerant to be condensed and then liquefied. Thereafter, the outdoor heat exchanger 32 causes the liquefied refrigerant to flow out toward the refrigerant pipe 5*b*. The outdoor heat exchanger 32 acts as an evaporator during the heating operation. Specifically, the outdoor heat exchanger 32 causes heat exchange to be performed between outdoor air and refrigerant reduced in pressure by the expansion valve 34 and flowing into the outdoor heat exchanger 32 from a refrigerant pipe 5*b* side to cause the refrigerant to be evaporated and vaporized, and then causes the refrigerant to flow out toward the refrigerant pipe 5*a*.

The outdoor fan 33 adjusts the flow of air during the heat exchange, performed by the outdoor heat exchanger 32, to increase efficiency of the heat exchange between refrigerant and outdoor air. The expansion valve 34 is an expansion device. The expansion valve 34 regulates the flow rate of refrigerant flowing through the expansion valve 34, thus serving as an expansion valve. The expansion valve 34 changes the opening degree thereof to adjust the pressure of refrigerant. The shutoff valve 60 suitably shuts off the cycle of refrigerant according to an instruction from a control unit 75 described later, for example.

The indoor unit 4 includes an indoor heat exchanger 40, a fan 41 and other components. FIG. 1 shows the components relating to the cycle of refrigerant from the components included in the indoor unit 4, and the illustration of other components is omitted in FIG. 1.

The indoor heat exchanger 40 causes heat exchange to be performed between refrigerant and indoor air. The indoor heat exchanger 40 acts as an evaporator during the coding operation. Specifically, the indoor heat exchanger 40 causes heat exchange to be performed between indoor air and refrigerant brought into a low pressure state by the expansion valve 34 to cause the refrigerant to remove heat of the indoor air, whereby the refrigerant is evaporated and vaporized. Thereafter, the indoor heat exchanger 40 causes the vaporized refrigerant to flow out toward the refrigerant pipe 5*a*. The indoor heat exchanger 40 acts as a condenser during the heating operation. Specifically, the indoor heat exchanger 40 causes heat exchange to be performed between indoor air and refrigerant flowing into the indoor heat exchanger 40 from a refrigerant pipe 5*a* side to cause the refrigerant to be condensed and liquefied. Thereafter, the indoor heat exchanger 40 causes the liquefied refrigerant to flow out toward the refrigerant pipe 5*b*.

The fan 41 adjusts the flow of air during the heat exchange performed by the indoor heat exchanger 40 to increase efficiency of the heat exchange between refrigerant and indoor air. When the leakage of refrigerant from the refrigerant circuit 2 is detected, the fan 41 performs an operation action according to an instruction from the control unit 75 described later.

(Refrigerant)

As described above, the air-conditioning apparatus 1 causes refrigerant to cycle through the refrigerant circuit 2 to cause heat exchange to be performed between refrigerant and air, thus conditioning air. A situation where the air-conditioning apparatus 1 according to Embodiment of the present disclosure uses refrigerant having flammability (also referred to as "flammable refrigerant"), such as R32, for example, is presumed. When such flammable refrigerant leaks from the refrigerant circuit 2, and the concentration of the flammable refrigerant in air becomes equal to or more than a fixed concentration (also referred to as "lower flammability limit concentration"), ignition may be caused. For example, when a calculation is made presuming that the molecular weight of R32 is 52 and a room temperature is 25 degrees C., the lower flammability limit concentration of R32 is 0.3 [kg/m$^3$], and is 14.4 in terms of a volume ratio. Refrigerant is not limited to R32. A slightly flammable refrigerant, such as R1234yf or R1234ze (E), or a highly flammable refrigerant, such as R290 or R1270, may be used, or a non-flammable refrigerant having non-flammability, such as R22 or R410A, may also be used as the refrigerant. Hereinafter, the description will be made for the components included in the air-conditioning apparatus 1 for detecting the leakage of refrigerant and managing the leakage. In the description made hereinafter, it is assumed that the indoor unit 4 includes a constitutional element that detects the leakage of refrigerant. However, the configuration is not limited to the above.

(Indoor Unit)

Figure 2:
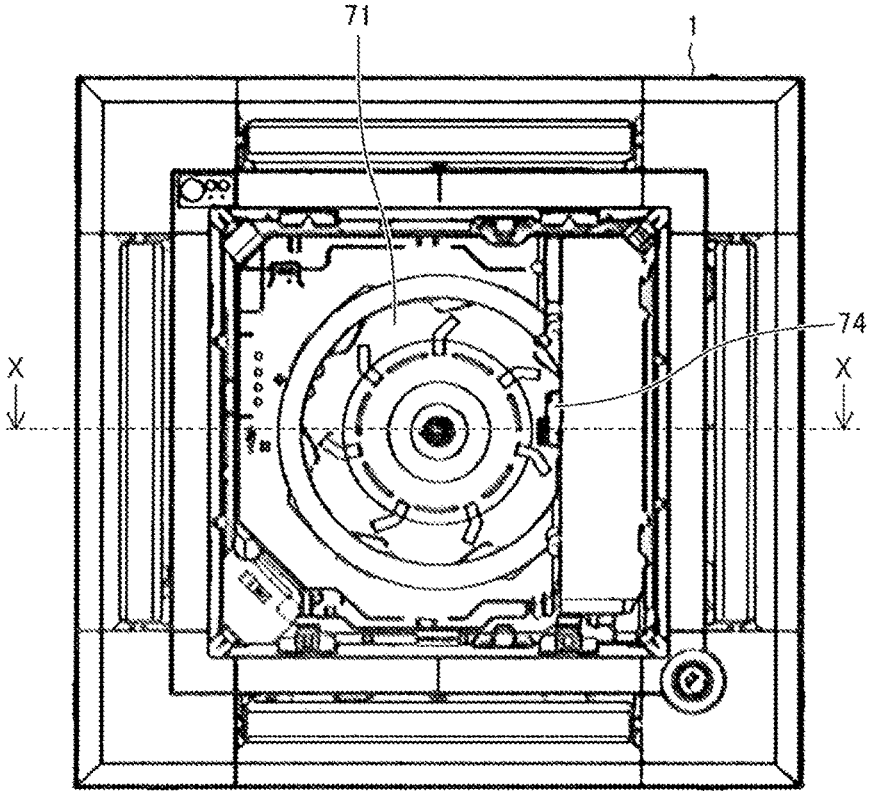
FIG. 2 is a diagram showing one example of an indoor unit according to Embodiment of the present disclosure.
Figure 3:
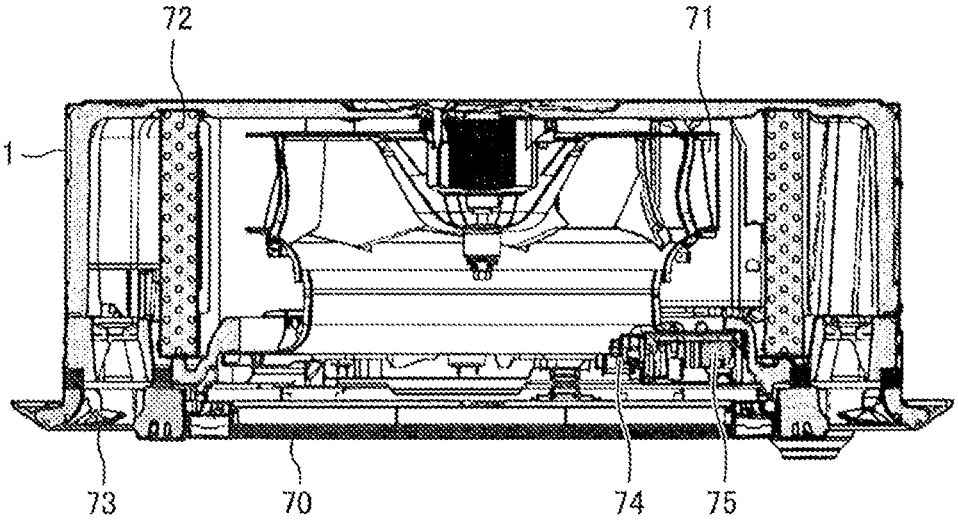
FIG. 3 is a diagram showing an X-X cross section of the indoor unit relating to one example of Embodiment of the present disclosure.

FIG. 2 is a diagram showing one example of the indoor unit 4 according to Embodiment of the present disclosure. The indoor unit 4 in this example is installed to a ceiling portion of a room. FIG. 2 shows the indoor unit 4 as viewed from the bottom in the vertical direction with a cover that covers the front side of the indoor unit 4 removed. FIG. 3 is a diagram showing an X-X cross section of the indoor unit 4 relating to one example of Embodiment of the present disclosure. The indoor unit 4 includes an air inlet 70, a fan 71, an indoor heat exchanger 72, an air outlet 73, a refrigerant sensor 74, the control unit 75, and other components.

The air inlet 70 is an opening port that allows the indoor unit 4 to suction indoor air into the inside of the indoor unit 4. The fan 71 corresponds to the fan 41 described with reference to FIG. 1. The fan 71 introduces the indoor air into the indoor unit 4 through the air inlet 70. The indoor heat exchanger 72 corresponds to the above-mentioned indoor heat exchanger 40, and causes heat exchange to be performed between air suctioned into the indoor unit 4 by the fan 71 and refrigerant in the inside thereof. The air outlet 73 is an opening port that allows air, subjected to heat exchange with refrigerant by the indoor heat exchanger 72, to be blown out to the inside of the room.

The refrigerant sensor 74 measures a concentration in air of refrigerant leaked into the air. In Embodiment, "in air" also includes "in air suctioned into the inside of the indoor unit 4 by the fan 71". The control unit 75 controls the entire air-conditioning apparatus 1 or a part of the air-conditioning apparatus 1. Hereinafter, to facilitate the understanding, the components of the indoor unit 4, such as the refrigerant sensor 74 and the control unit 75, will be described with reference to FIG. 4 together with FIG. 2 and FIG. 3.

Figure 4:
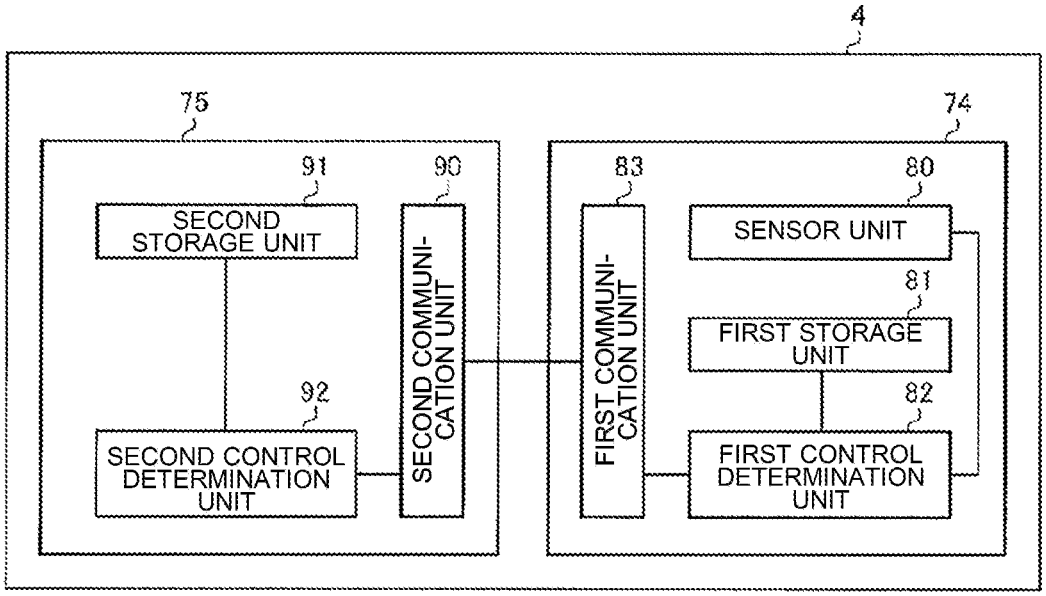
FIG. 4 is a diagram illustrating components included in the indoor unit according to Embodiment of the present disclosure.

FIG. 4 is a diagram illustrating the components included in the indoor unit 4 according to Embodiment of the present disclosure. The above-mentioned air inlet 70, fan 71, indoor heat exchanger 72, air outlet 73, and other components are omitted in FIG. 4. Further, the connection relationship between the respective components shown in FIG. 4 merely forms an example. As shown in FIG. 4, the refrigerant sensor 74 includes a sensor unit 80, a first storage unit 81, a first control determination unit 82, a first communication unit 83, and other components.

The sensor unit 80 measures a value indicating the concentration of refrigerant. The sensor unit 80 of Embodiment of the present disclosure is a semiconductor gas sensor. Hereinafter, the description will be made by taking as an example tin oxide ($SnO_2$) sensor, being a type of semiconductor gas sensor. The refrigerant leakage detection principle for the tin oxide sensor will be described. The tin oxide sensor includes tin oxide as a sensor unit, and oxygen in air is adsorbed on the surface of the tin oxide by energization. Further, refrigerant in the form of a gas (also referred to as "refrigerant gas", and also collectively referred to as "refrigerant") has reducibility. When the refrigerant gas approaches the sensor unit, the surface of the tin oxide is deprived of oxygen due to the reduction reaction and, as a result, the resistance value of the sensor element reduces. With such reduction in the resistance value, the voltage of the sensor unit 80 increases. The higher the concentration of refrigerant in air, the more the voltage of the sensor unit 80 increases. The sensor unit 80 measures this voltage value, and outputs the voltage value as a value indicating the concentration of refrigerant in air. Note that the sensor unit 80 is one example of a measuring unit.

The first storage unit 81 is configured to include a memory, such as a read only memory (ROM) or a random access memory (RAM). The first storage unit 81 stores a first threshold and a second threshold. The second threshold is a value greater than the first threshold.

The first control determination unit 82 is configured to include a processor, such as a central processing unit (CPU) or a micro processing unit (MPU). The first control determination unit 82 determines whether a voltage value outputted from the sensor unit 80 is less than the first threshold set in advance, is equal to or more than the first threshold and less than the second threshold, or is equal to or more than the second threshold.

When an output value from the sensor unit 80 is equal to or more than the first threshold, the first control determination unit 82 determines that refrigerant is leaked. The first threshold is set to a voltage value corresponding to a concentration lower than the lower flammability limit concentration. The concentration of refrigerant corresponding to the first threshold is also referred to as "notification concentration" hereinafter. In Embodiment of the present disclosure, the notification concentration is presumed to be 1% of the lower flammability limit concentration I presumed to be notification concentration, for example. However, the notification concentration is not limited to the above.

The first control determination unit 82 determines that refrigerant is leaked also when the output value from the sensor unit 80 is equal to or more than the second threshold. In Embodiment of the present disclosure, it is presumed that the second threshold is a voltage value corresponding to a concentration equal to or less than ten percent of the lower flammability limit concentration.

When leakage of refrigerant is determined, the first storage unit 81 may store information indicating the leakage of refrigerant during a period where power is supplied to the refrigerant sensor 74. The first control determination unit 82 may notify, via an output unit not shown in the drawing, a user of a fact that refrigerant is leaked based on the information indicating the leakage.

The first communication unit 83 is configured to include a communication interface. The first control determination unit 82 transmits the determination result to the control unit 75 via the first communication unit 83 at intervals of one minute, for example. Alternatively, it may be configured such that the first control determination unit 82 transmits the determination result to the control unit 75 when the first control determination unit 82 determines that refrigerant is leaked, and the first control determination unit 82 does not transmit the determination result other than the above-mentioned case. It may also be configured such that the first control determination unit 82 distinguishes a determination result when the output value from the sensor unit 80 is equal to or more than the second threshold and a determination result when the output value is equal to or more than the first threshold and is less than the second threshold, and the first control determination unit 82 transmits the determination result to the control unit 75. The first control determination unit 82 may output data of voltage values measured by the sensor unit 80 to the control unit 75 together with the determination result or in place of the determination result. In the case where the first control determination unit 82 transmits only the output value from the sensor unit 80 to the control unit 75 the control unit 75 may perform the above-mentioned processing of determining the presence or absence of the leakage of refrigerant. Further, in the case where the first storage unit 81 stores information indicating the leakage of refrigerant, the first control determination unit 82 may transmit the information indicating the leakage to the control unit 75 via the first communication unit 83.

The control unit 75 detects an abnormality in the sensor unit 80 of the refrigerant sensor 74 based on information received from the refrigerant sensor 74. An abnormality of the sensor unit 80 indicates deterioration or failure of the sensor unit 80 caused by exposure to a refrigerant gas for a long time or exposure to a refrigerant gas with a high concentration. The deterioration or failure of the sensor unit 80 may cause a reduction in accuracy in detection of the leakage of refrigerant, or may cause a state where the leakage of refrigerant cannot be detected, or cannot be easily detected. The control unit 75 performs a processing of detecting such deterioration or failure of the sensor unit 80. The control unit 75 also controls all or some of the components of the air-conditioning apparatus 1. The control unit 75 prohibits the action of the compressor 30, causes the fan 41 (71) to perform a processing of agitating refrigerant, or causes the shutoff valve 60 to prevent refrigerant from flowing into the indoor unit 4 when necessary.

The control unit 75 includes a second communication unit 90, a second storage unit 91, a second control determination unit 92, and other components. The second communication unit 90 is configured to include a communication interface. The second communication unit 90 receives information from the refrigerant sensor 74. The second communication unit 90 transmits a control signal to at least one of the compressor 30, the fan 41 (71), the shutoff valve 60, and other components according to an instruction from the second control determination unit 92.

The second storage unit 91 is configured to include a memory, such as a ROM or a RAM. Based on the determination result from the first control determination unit 82, which is received from the refrigerant sensor 74, the second storage unit 91 cumulates and stores at least one of an elapsed time period during a determination of leakage of refrigerant and the number of times of the determination of leakage of refrigerant. Hereinafter, a cumulative time period of the elapsed time period during a determination of leakage of refrigerant is also abbreviated as "cumulative time period". In the same manner, the cumulative number of times of the determination of leakage of refrigerant is also abbreviated as "cumulative number of times". The first storage unit 81 may cumulate and store at least one of the elapsed time period and the number of times in cooperation with or in place of the second storage unit 91, and the stored content may be transmitted from the refrigerant sensor 74 to the control unit 75.

The second control determination unit 92 is configured to include a processor, such as a CPU or an MPU. The second control determination unit 92 detects an abnormality in the sensor unit 80 of the refrigerant sensor 74. Specifically, the second control determination unit 92 determines the presence or absence of the abnormality in the sensor unit 80 based on at least one of the cumulative time period, the cumulative number of times, and the presence or absence of exposure of the sensor unit 80 to a refrigerant gas with a high concentration. To be more specific, the second control determination unit 92 determines that the sensor unit 80 has the abnormality when at least one of the following three conditions is satisfied.

Condition 1. A cumulative time period stored in the second storage unit 91 (or the first storage unit 81) is longer than the predetermined time period.

Condition 2. The cumulative number of times stored in the second storage unit 91 (or the first storage unit 81) is greater than the predetermined number.

Condition 3. An output value from the sensor unit 80 is equal to or more than the second threshold.

The term "predetermined time period" in the condition 1 is a time period predetermined by an experiment or the like. An example of "predetermined time period" may be a cumulative time period from the point of time when the sensor unit 80 is attached to the air-conditioning apparatus 1 to the point of time when a voltage value corresponding to the lower flammability limit concentration becomes unable to be measured.

The term "predetermined number" in the condition 2 is the number predetermined by an experiment or the like. An example of "predetermined number" may be a cumulative number of times from the point of time when the sensor unit 80 is installed to the point of time when the voltage value corresponding to the lower flammability limit concentration becomes unable to be measured under a condition where the concentration of refrigerant in air is predetermined (for example, the concentration is 1%).

As described above, the term "second threshold" in the condition 3 is a voltage value corresponding to a concentration equal to or less than ten percent of the lower flammability limit concentration. The second threshold is presumed as a voltage value corresponding to a high concentration at which deterioration of the sensor unit 80 increases within a short time period when the sensor unit 80 is exposed to a refrigerant gas.

When the second control determination unit 92 determines that the sensor unit 80 has an abnormality, the second storage unit 91 stores information indicating the abnormality in the sensor unit 80. This information is held until the refrigerant sensor 74 is replaced even when the power source of the air-conditioning apparatus 1 is turned off. Based on the determination that the sensor unit 80 has an abnormality or the information stored in the second storage unit 91 and indicating the abnormality in the sensor unit 80, the second control determination unit 92 outputs at least one of a warning indicating the abnormality in the refrigerant sensor 74, a warning to replace the refrigerant sensor 74, and other warning via an output unit not shown in the drawing. The information indicating the abnormality in the sensor unit 80 may be transmitted to the refrigerant sensor 74 by the second control determination unit 92 via the second communication unit 90, and may be stored by the first storage unit 81. In this case, the information indicating the abnormality in the sensor unit 80 is reserved in the first storage unit 81 even when supply of power to the refrigerant sensor 74 is stopped. In this case, the first control determination unit 82 may output a warning indicating the abnormality in the refrigerant sensor 74 or a warning to replace the refrigerant sensor 74 via an output unit not shown in the drawing based on the information indicating the abnormality in the sensor unit 80.

Based on the determination that the sensor unit 80 has an abnormality or information stored in the second storage unit 91 and indicating the abnormality, the second control determination unit 92 prohibits an action of conditioning air (also referred to as "air conditioning action") performed by the air-conditioning apparatus 1. At this point of operation, the second control determination unit 92 transmits a control signal for controlling each equipment at the destination to at least one of the compressor 30, the fan 41 (71), and the shutoff valve 60, for example, via the second communication unit 90. The compressor 30 that receives the control signal stops the action. The fan 41 (71) that receives the control signal performs a processing of agitating refrigerant in air. The shutoff valve 60 that receives the control signal performs a refrigerant shutoff processing.

When leakage of refrigerant is determined, the second control determination unit 92 may prohibit the air conditioning action based on the determination result or the information stored in the first storage unit 81 and indicating leakage, for example. In this case, when none of the above-mentioned conditions 1 to 3 is satisfied, the second control determination unit 92 restarts the air conditioning action by rebooting the air-conditioning apparatus 1. Alternatively, when leakage of refrigerant is determined, but none of the above-mentioned conditions 1 to 3 is satisfied, the second control determination unit 92 may not prohibit the air conditioning action. The reason is as follows. When leakage of refrigerant is determined, but none of the above-mentioned conditions 1 to 3 is satisfied, it is considered that the degree of exposure of the refrigerant sensor 74 to refrigerant is an extent that the exposure does not cause a change in characteristics of the refrigerant sensor 74.

Each of the first storage unit 81 and the second storage unit 91 is an example of a storage unit. Each of the first control determination unit 82 and the second control determination unit 92 is an example of a control determination unit.

(Abnormality Monitoring Processing Performed by Air-Conditioning Apparatus 1)

Figure 5:
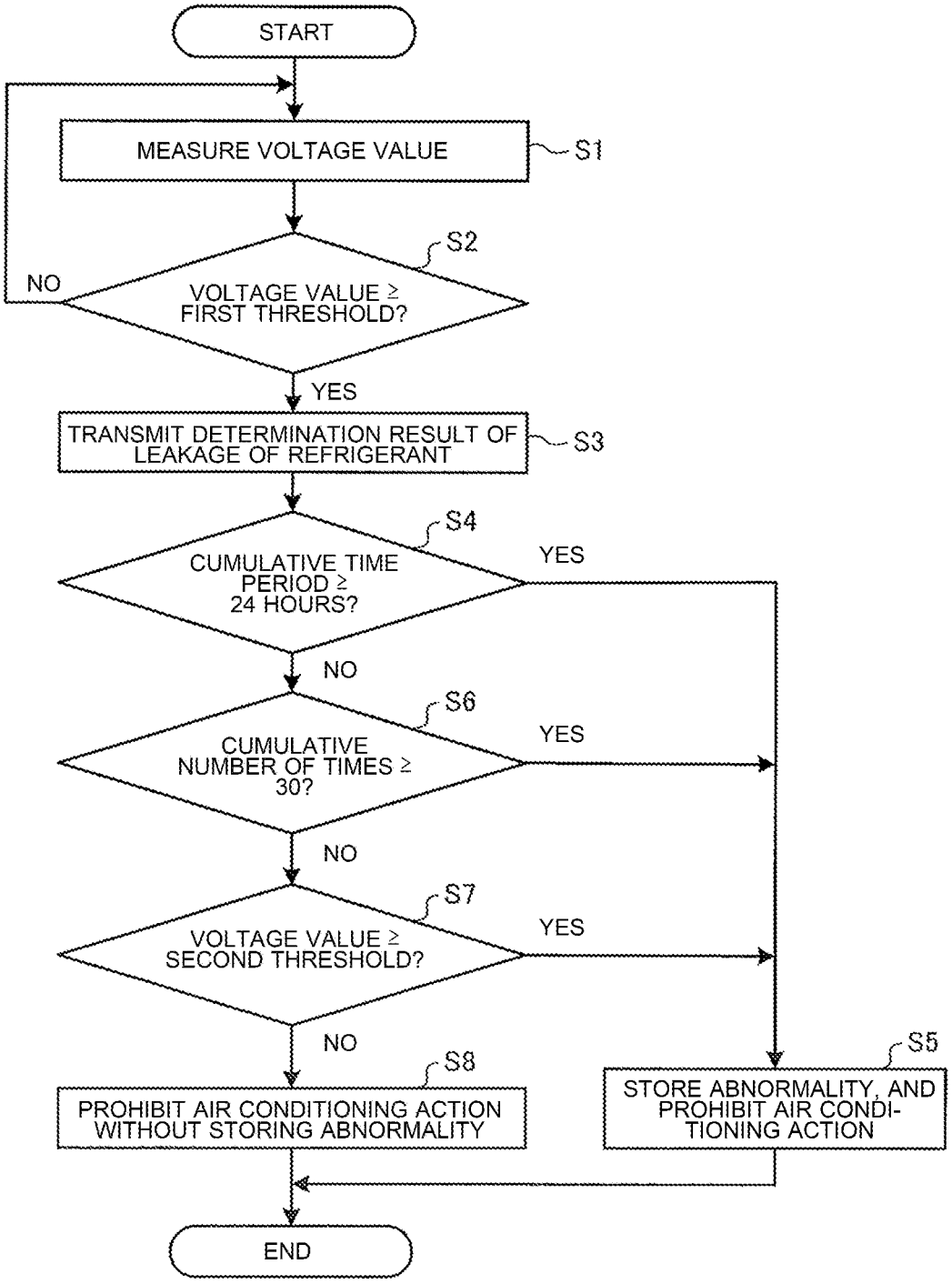
FIG. 5 is a flowchart showing one example of an abnormality monitoring processing performed by the air-conditioning apparatus according to Embodiment of the present disclosure.

FIG. 5 is a flowchart showing one example of an abnormality monitoring processing performed by the air-conditioning apparatus 1 according to Embodiment of the present disclosure. In step S1, the sensor unit 80 of the refrigerant sensor 74 measures a voltage value corresponding to the concentration of refrigerant in air (step S1). In step S1, the refrigerant sensor 74 may transmit the measured voltage value to the control unit 75.

In step S2, the first control determination unit 82 of the refrigerant sensor 74 determines whether the voltage value measured by the sensor unit 80 is equal to or more than the first threshold to determine the presence or absence of the leakage of refrigerant (step S2). When the voltage value measured by the sensor unit 80 is smaller than the first threshold (step S2: No), the abnormality monitoring processing performed by the air-conditioning apparatus 1 returns to step S1. In this case, in step S1, the refrigerant sensor 74 may transmit the determination result obtained in step S2 to the control unit 75.

When the voltage value is equal to or more than the first threshold (step S2: Yes), in step S3, the first control determination unit 82 transmits the determination result that refrigerant is leaked to the control unit 75 (step S3). At this point of operation, the second storage unit 91 of the control unit 75 cumulates and stores a time period elapsed during the determination of leakage of refrigerant and the number of times of the determination of leakage of refrigerant.

In step S4, the second control determination unit 92 of the control unit 75 determines whether the cumulative time period stored in the second storage unit 91 is equal to or more than the predetermined time period. Assume that the predetermined time period in this example is 24 hours.

When the cumulative time period is equal to or more than 24 hours (step S4: Yes), in step S5, the second storage unit 91 (or the first storage unit 81) stores information indicating the abnormality in the refrigerant sensor 74, and the second control determination unit 92 prohibits the air conditioning action of the air-conditioning apparatus 1. After the processing in step S5 is performed, the abnormality monitoring processing is finished.

When the cumulative time period is less than 24 hours (step S4: No), in step S6, the second control determination unit 92 determines whether the cumulative number of times stored in the second storage unit 91 (or the first storage unit 81) is equal to or more than the predetermined number. Assume that the predetermined number in this example is 30.

When the cumulative number of times is equal to or more than 30 (step S6: Yes), the abnormality monitoring processing advances to step S5. When the cumulative number of times is less than 30 (step S6: No), in step S7, the second control determination unit 92 determines whether the voltage value measured by the sensor unit 80 is equal to or more than the second threshold.

When the voltage value is equal to or more than the second threshold (step S7: Yes), the abnormality monitoring processing advances to step S5.

When the voltage value is less than the second threshold (step S7: No), in step 38, the second storage unit 91 (or the first storage unit 81) does not store information indicating the abnormality in the refrigerant sensor 74, and the second control determination unit 92 prohibits the air conditioning action (step S8). After step S8 is performed, the air-conditioning apparatus 1 finishes the abnormality monitoring processing. In this case, the air conditioning action is restarted when the air-conditioning apparatus 1 is rebooted. The air-conditioning apparatus 1 may return to the processing in step S1 in place of performing the processing in step S8.

Figure 6:
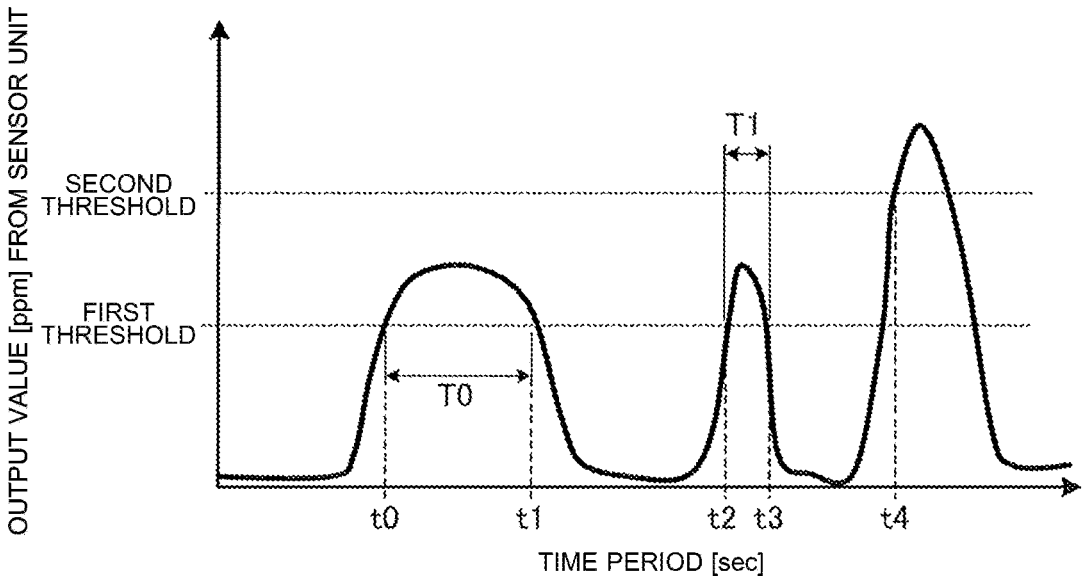
FIG. 6 is a graph for describing specific contents of the abnormality monitoring processing performed by the air-conditioning apparatus according to Embodiment of the present disclosure.

FIG. 6 is a graph for describing specific contents of the abnormality monitoring processing performed by the air-conditioning apparatus 1 according to Embodiment of the present disclosure. The sensor unit 80 outputs a voltage value of equal to or more than the first threshold and less than the second threshold within a time period T0 ranging from a point of time t0 to a point of time t1. In the same manner, the sensor unit 80 outputs a voltage value of equal to or more than the first threshold and less than the second threshold within a time period T1 ranging from a point of time t2 to a point of time t3. Therefore, the second storage unit 91 (or the first storage unit 81) stores, at the point of time t3, the sum of the time period T0 and the time period T1 as a cumulative time period elapsed in a state where leakage of refrigerant is determined. A situation where the sum of the time period T0 and the time period T1 is less than the predetermined time period is presumed. Also a situation where the cumulative number of times of the determination of leakage of refrigerant is less than the predetermined number within a period between the time period T0 and the time period T1 is presumed. Therefore, the second storage unit 91 (or the first storage unit 81) does not store information indicating the abnormality in the refrigerant sensor 74.

At a point of time t4, the sensor unit 80 outputs a voltage value of equal to or more than the second threshold. Therefore, the second storage unit 91 (or the first storage unit 81) stores information indicating the abnormality in the refrigerant sensor 74, and the second control determination unit 92 performs a processing of prohibiting the air conditioning action.

Other Embodiments

In the above-mentioned Embodiment, the description has been made for the case where the air-conditioning apparatus 1 includes one outdoor unit 3 and one indoor unit 4. Further, the indoor unit 4 includes the refrigerant sensor 74 and the control unit 75 shown in FIG. 3. However, the air-conditioning apparatus 1 may include two or more indoor units 4 or two or more outdoor units 3. In the case where the air-conditioning apparatus 1 includes the two or more indoor units 4, each indoor unit 4 includes the above-mentioned refrigerant sensor 74, and each of all or some of the two or more indoor units 4 may include the control unit 75. Each indoor unit 4 detects the leakage of refrigerant flowing through the inside of the indoor unit 4 using the refrigerant sensor 74. When the indoor unit 4 having no control unit 75 detects the leakage of refrigerant, the indoor unit 4 may transmit the determination result relating to the leakage of refrigerant or may transmit an output value from the sensor unit 80, for example, to the indoor unit 4 including the control unit 75 via the first communication unit 83. The control unit 75 of the indoor unit 4 that receives the determination result that the leakage of refrigerant is present may perform the processing of prohibiting the air conditioning action, or may control the shutoff valve 60 to prevent refrigerant from flowing into the indoor unit 4 that detects the leakage of refrigerant.

Advantageous Effect

In the air-conditioning apparatus 1 according to the present disclosure, necessity of the prohibition of the air conditioning action and necessity of the replacement of the refrigerant sensor 74 are determined based on at least one of the cumulative time period of the elapsed time period during the determination of the leakage of refrigerant, the cumulative number of times of the determination of leakage of refrigerant, and the presence or absence of the leakage of refrigerant with a high concentration. With such a configuration, it is possible to prevent the further use of the refrigerant sensor 74 that is deteriorated due to exposure to a refrigerant gas, so may cause an erroneous detection when refrigerant is leaked. Accordingly, it is possible to prevent omission of detection of refrigerant.

Further, in the air-conditioning apparatus 1 according to the present disclosure, there is no possibility that each time the leakage of refrigerant is detected, the air conditioning action is prohibited until the refrigerant sensor 74 is replaced even when there is no further deterioration of the refrigerant sensor 74. Accordingly, it is possible to improve convenience for a person who uses the air-conditioning apparatus 1. It is also possible to reduce costs of time and money required for the replacement of the refrigerant sensor 74.

The content of the present disclosure is not limited to the content of the above-mentioned Embodiment, and includes various modifications that can be read from CLAIMS, entire specification, and drawings without departing from the gist of the disclosure or the scope of the technical concept.

REFERENCE SIGNS LIST

1: air-conditioning apparatus, 2: refrigerant circuit, 3: outdoor unit, 4: indoor unit, 5*a*, 5*b*: refrigerant pipe, 30: compressor, 31: flow passage switching device, 32: outdoor heat exchanger, 33: outdoor fan, 34: expansion valve, 40: indoor heat exchanger, 41: fan, 60: shutoff valve, 70: air inlet, 71: fan, 72: indoor heat exchanger, 73: air outlet, 74: refrigerant sensor, 75: control unit, 80: sensor unit, 81: first storage unit, 82: first control determination unit, 83: first communication unit, 90: second communication unit, 91: second storage unit, 92: second control determination unit.

The invention claimed is:

1. An air-conditioning apparatus that causes refrigerant to cycle through the air-conditioning apparatus to cause heat exchange to be performed between the refrigerant and indoor and outdoor air, thus performing an air conditioning action, the air-conditioning apparatus comprising:

a sensor configured to measure a concentration in air of any of the refrigerant leaked into the air;

a control determination device configured to determine leakage of the refrigerant in a case where a value indicating the concentration measured by the sensor is equal to or more than a first threshold; and a memory configured to store a cumulative time period that is a sum of time elapsed during one or more determinations of the leakage of the refrigerant and a cumulative number of times of the one or more determinations of the leakage of the refrigerant, wherein the control determination device is further configured to determine an abnormality in the sensor, and prohibit the air conditioning action, in any one of:

a case where the cumulative time period is equal to or more than a predetermined time period, a case where the cumulative number of times is equal to or more than a predetermined number, and a case where the value indicating the concentration is equal to or more than a second threshold, the second threshold being a value greater than the first threshold.

2. The air-conditioning apparatus of claim 1, wherein in any case where the accumulated time period is equal to or more than the predetermined time period, the accumulated number of times is equal to or more than the predetermined number, or the value indicating the concentration is equal to or more than the second threshold, the memory stores information indicating the abnormality in the sensor, the information being held even when power supplied to the sensor is stopped, and the control determination device prohibits the air conditioning action based on the information indicating the abnormality in the sensor, both before power supplied to the sensor is stopped and after power supplied to the sensor is restarted.

3. The air-conditioning apparatus of claim 1, wherein in a case where the cumulative time period is shorter than the predetermined time period, the cumulative number of times is smaller than the predetermined number, and the value indicating the concentration is a value smaller than the second threshold, the control determination device is prevented from prohibiting the air conditioning action based on the determination of the abnormality in the sensor, or is prevented from prohibiting the air conditioning action performed after the air-conditioning apparatus is rebooted.

4. The air-conditioning apparatus of claim 1, wherein the predetermined time period is determined by experiment or testing, which estimates a time of deterioration of the sensor from determining leakage until the sensor becomes unable to measure a lower flammability limit concentration of the refrigerant.

5. The air-conditioning apparatus of claim 1, wherein the predetermined number is determined by experiment or testing as a number of times the determination unit determines leakage until the sensor becomes unable to measure a lower flammability limit concentration of the refrigerant.

6. The air-conditioning apparatus of claim 5, wherein the concentration corresponding to the first threshold is equal to or less than one percent, the first threshold being predetermined.

7. The air-conditioning apparatus of claim 1, wherein the concentration corresponding to the second threshold is equal to or less than ten percent of a lower flammability limit concentration of the refrigerant.

8. The air-conditioning apparatus of claim 1, comprising an indoor unit that is provided to a refrigerant circuit, through which the refrigerant cycles, and that includes the sensor, heat exchange between indoor air and the refrigerant being performed in the indoor unit, and a shutoff valve configured to shut off an inflow of the refrigerant into the indoor unit from the refrigerant circuit according to an instruction from the control determination unit in a case where leakage of the refrigerant is determined.

9. The air-conditioning apparatus of claim 1, further comprising a fan configured to agitate any of the refrigerant leaked into the air, according to an instruction from the control determination unit, when the control determination device determine the leakage of the refrigerant.

10. The air-conditioning apparatus of claim 1, comprising a compressor configured to compress the refrigerant, the compressor being provided on the refrigerant circuit through which the refrigerant cycles, wherein the control determination device stops an operation of the compressor when the control determination device determine the leakage of the refrigerant.

* * * * *